US012723788B2

(12) United States Patent
Lee et al.

(10) Patent No.: US 12,723,788 B2
(45) Date of Patent: Sep. 1, 2026

(54) HEAT PUMP AND CONTROL METHOD THEREOF

(71) Applicant: KYUNGDONG NAVIEN CO., LTD., Pyeongtaek-si (KR)

(72) Inventors: Dong Keun Lee, Seoul (KR); In Soo Hwang, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 47 days.

(21) Appl. No.: 18/754,537

(22) Filed: Jun. 26, 2024

(65) Prior Publication Data

US 2025/0003654 A1 Jan. 2, 2025

(30) Foreign Application Priority Data

Jun. 30, 2023 (KR) ..... 10-2023-0084998
Jan. 15, 2024 (KR) ..... 10-2024-0006212

(51) Int. Cl.

*F25B 41/26* (2021.01)
*F25B 13/00* (2006.01)
*F25B 47/02* (2006.01)
*F25B 49/02* (2006.01)

(52) U.S. Cl.

CPC ..... *F25B 41/26* (2021.01); *F25B 13/00* (2013.01); *F25B 47/02* (2013.01); *F25B 49/02* (2013.01); *F25B 2600/2515* (2013.01)

(58) Field of Classification Search

CPC ..... F25B 41/26; F25B 13/00; F25B 47/02; F25B 49/02; F25B 2600/2515

See application file for complete search history.

(56) References Cited

U.S. PATENT DOCUMENTS

2015/0204626 A1* 7/2015 Martell ..... F28C 1/14 165/200

FOREIGN PATENT DOCUMENTS

| | | | |
|---|---|---|---|
| CN | 111023372 A | * | 4/2020 |
| KR | 1020040052049 A | | 6/2004 |
| KR | 1020190006781 A | | 1/2019 |
| KR | 1020210070921 A | | 6/2021 |
| KR | 1020220074734 A | | 6/2022 |

OTHER PUBLICATIONS

Yafeng et al., Heat Pump System of Air-Conditioner . . . , Apr. 17, 2020, CN111023372A, Whole Document (Year: 2020).*

* cited by examiner

*Primary Examiner* — Larry L Furdge
(74) *Attorney, Agent, or Firm* — Dority & Manning, PA

(57) ABSTRACT

A heat pump and a control method thereof is provided. The heat pump includes: a first heat exchanger disposed indoors, a second heat exchanger and a third heat exchanger disposed outdoors, a fluid tube connected to the first heat exchanger, the second heat exchanger and the third heat exchanger, a compressor and an expansion valve unit disposed on the fluid tube, a flow path switching valve unit configured to switch a path of a fluid discharged from the compressor to flow into at least one of the first heat exchanger, the second heat exchanger and the third heat exchanger, a processor connected to the flow path switching valve unit, and a storage unit connected to the processor.

10 Claims, 8 Drawing Sheets

HEAT PUMP AND CONTROL METHOD THEREOF

CROSS-REFERENCE TO RELATED APPLICATION(S)

This application claims benefit of priority to Korean Patent Application No. 10-2023-0084998, filed on Jun. 30, 2023, and Korean Patent Application No. 10-2024-0006212, filed on Jan. 15, 2024, the disclosures of which are incorporated herein by reference in their entireties for all purposes.

BACKGROUND

1. Field

The present disclosure relates to a heat pump and a control method thereof.

2. Description of Related Art

Generally, a heat pump is a device cooling an indoor space during a cooling operation or heating an indoor space during a heating operation, and specifically, in the case of a cooling operation, heat passes through the compressor and is released to the outside in an outdoor heat exchanger installed outside, and an indoor heat exchanger disposed indoors absorbs indoor heat through a pressure reducing means and performs evaporation, thereby cooling the indoor space. In case of heating operation, a refrigerant evaporated from an outdoor heat exchanger disposed outside is compressed through a compressor, and the compressed high-temperature, high-pressure refrigerant condenses in an indoor heat exchanger disposed indoors and releases heat into the indoor space to heat the indoor space. Here, the outdoor heat exchanger uses an outdoor air heat source to operate as a condenser during cooling operation and as an evaporator during a heating operation.

For this heat pump, specifically, during heating operations in situations in which an outdoor temperature is low, a low-temperature fluid flowing through the outdoor heat exchanger may cause frost formation in the outdoor heat exchanger due to insufficient absorption of heat energy outdoors, and furthermore, a problem of reduced heating efficiency may occur due to an insufficient temperature increase of the fluid passing through the outdoor heat exchanger. Meanwhile, in the case of a heat pump operating in an area in which an outdoor temperature is not low and a ratio of cooling operation to heating operation is high, there is a need to research and develop technologies that may secure both cooling and heating performance in heat pumps.

PRIOR ART REFERENCE

Patent Document (Patent Document 1) KR10-2004-0052049 A (Jun. 19, 2004)

SUMMARY

In order to achieve the aforementioned purpose, according to an embodiment of the present invention, provided is a heat pump, comprising: a first heat exchanger disposed indoors, a second heat exchanger and a third heat exchanger disposed outdoors, a fluid tube connected to the first heat exchanger, the second heat exchanger and the third heat exchanger, a compressor and an expansion valve unit disposed on the fluid tube, a flow path switching valve unit configured to switch a path of a fluid discharged from the compressor to flow into at least one of the first heat exchanger, the second heat exchanger and the third heat exchanger, a processor connected to the flow path switching valve unit, and a storage unit connected to the processor, wherein the second heat exchanger and the third heat exchanger are disposed to be connected in series or in parallel to each other by the flow path switching valve unit on the fluid tube, and the storage unit includes a program changing a heating mode in which the flow path switching valve unit controls a fluid from the compressor to flow into the first heat exchanger so that the first heat exchanger operates as a condenser and at least one of the second heat exchanger and the third heat exchanger operates as an evaporator, and a cooling mode in which the flow path switching valve unit controls the fluid of the compressor to flow into at least one of the second heat exchanger and the third heat exchanger so that the first heat exchanger operates as an evaporator and at least one of the second heat exchanger and the third heat exchanger operates as a condenser.

The heat pump includes a water injection module including a flow rate control valve disposed adjacently to the second heat exchanger and the third heat exchanger to control supply of water provided to at least one of the second heat exchanger and the third heat exchanger, wherein the processor may be connected to the flow rate control valve, and the program may be set to close the flow rate control valve in the heating mode and open the flow rate control valve in the cooling mode.

The flow path switching valve unit may include a first flow path switching valve configured to control the fluid of the compressor to flow into the first heat exchanger or the second heat exchanger, and a second flow path switching valve configured to control the fluid of the compressor to flow into the first heat exchanger or the third heat exchanger. The program may be set to connect the second heat exchanger and the third heat exchanger in parallel by control of the first flow path switching valve and the second flow path switching valve in the heating mode and the cooling mode.

When one of the second heat exchanger and the third heat exchanger needs to be defrosted in the heating mode, the program may be set to connect the second heat exchanger and the third heat exchanger in series by the control of the first flow path switching valve and the second flow path switching valve.

The water injection module may include a first water injection device including a first flow rate control valve disposed adjacently to the second heat exchanger and configured to control supply of water provided to the second heat exchanger, and a second water injection device including a second flow rate control valve disposed adjacently to the third heat exchanger and configured to control supply of water provided to the third heat exchanger.

The second heat exchanger and the third heat exchanger may be disposed on the fluid tube to be inclined at a predetermined angle in a vertical direction.

Meanwhile, according to another embodiment of the present disclosure, provided is a control method of a heat pump including: a first heat exchanger disposed indoors; a second heat exchanger and a third heat exchanger disposed outdoors; a water injection module disposed adjacently to the second heat exchanger and the third heat exchanger and configured to supply water to at least one of the second heat exchanger and the third heat exchanger; and a flow path switching valve unit configured to change a path of a fluid discharged from a compressor by connecting the second heat exchanger and the third heat exchanger in series or in parallel, to flow into at least one of the first heat exchanger, the second heat exchanger and the third heat exchanger, on a fluid tube connected to the first heat exchanger, the second heat exchanger and the third heat exchanger. In the control method of a heat pump according to an embodiment of the present disclosure, in a heating mode, the first heat exchanger operates as a condenser and the second heat exchanger and the third heat exchanger operate as evaporators, and in a cooling mode, the first heat exchanger operates as an evaporator, and the second heat exchanger and the third heat exchanger operate as condensers, so that water injection is controlled by the water injection module.

In the cooling mode, a blowing amount of an outdoor blower forming a flow of air passing through the second heat exchanger and the third heat exchanger may be controlled depending on an operating status of the water injection module.

A cleaning mode in which the first heat exchanger operates as a condenser for a certain period of time is controlled to be performed after the cooling mode.

In the cleaning mode, an operation of an indoor blower forming a flow of air passing through the first heat exchanger and an outdoor blower forming a flow of air passing through the second heat exchanger and the third heat exchanger may be stopped, and for a certain period of time, the first heat exchanger may operate as a condenser, and one of the second heat exchanger and the third heat exchanger connected in series by the flow path switching valve unit, which is subject to a cleaning target, may be controlled to operate as an evaporator to perform water injection by the water injection module, and the other of the second heat exchanger and the third heat exchanger may be controlled to operate as a condenser.

In the heating mode, when frost formation occurs in one of the second heat exchanger and the third heat exchanger, the first heat exchanger may be controlled to operate as a condenser, and one of the second heat exchanger and the third heat exchanger connected in series by the flow path switching valve unit, which is subject to a defrosting target, may be controlled to operate as a condenser and the other thereof may be controlled to perform a defrosting mode of operating as an evaporator.

According to a heat pump and a control method thereof according to an embodiment of the present invention, in a heating mode, heating performance may be secured using a second heat exchanger and a third heat exchanger, and furthermore, in a cooling mode, the cooling efficiency may be effectively improved by condensing a fluid more efficiently through water injection into at least one of the second heat exchanger and the third heat exchanger.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, with reference to the attached drawings, specific example embodiments of the present invention will be described. However, the concept of the present invention is not limited to the suggested embodiments. For example, those skilled in the art who understand the idea of the present invention may easily propose other degenerative inventions or other embodiments included within the scope of the concept of the present invention by adding, modifying, or deleting components in the scope of the same concept, but other degenerative inventions or other embodiments are also construed as being in the scope of the concept of the present invention.

Furthermore, throughout the specification, the terms "connected to" or "coupled to" are used to designate a connection or coupling of one element to another element and include both a case where an element is "directly connected or coupled to" another element and a case where an element is "indirectly connected or coupled to" another element via still another element. Furthermore, when a certain portion "includes" or "comprises" a certain component, this indicates that other components are not excluded and may be further included unless otherwise noted.

Figure 1:
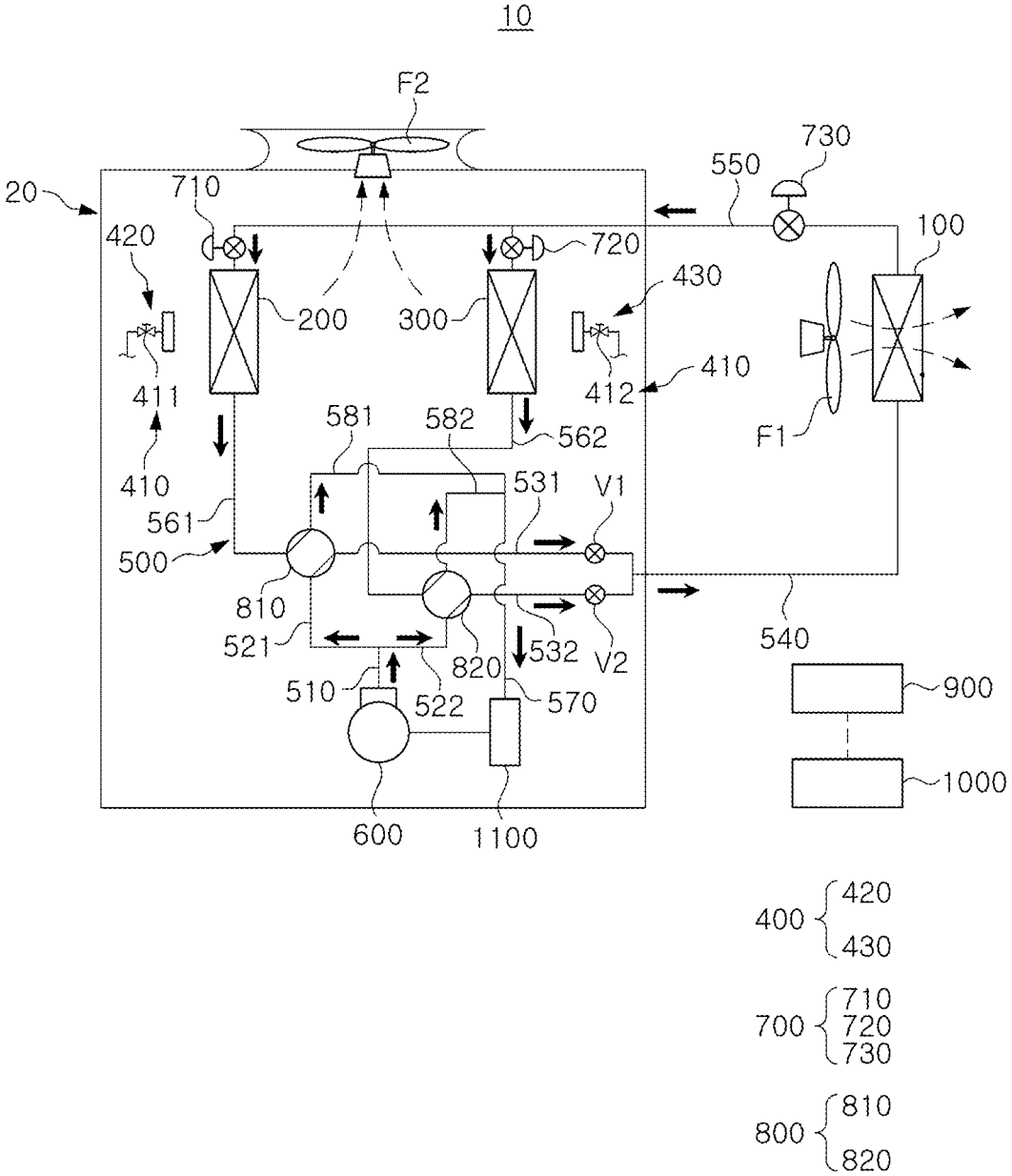
FIG. 1 is a schematic view illustrating an operation process in the heating mode of a heat pump according to an embodiment of the present invention.
Figure 2:
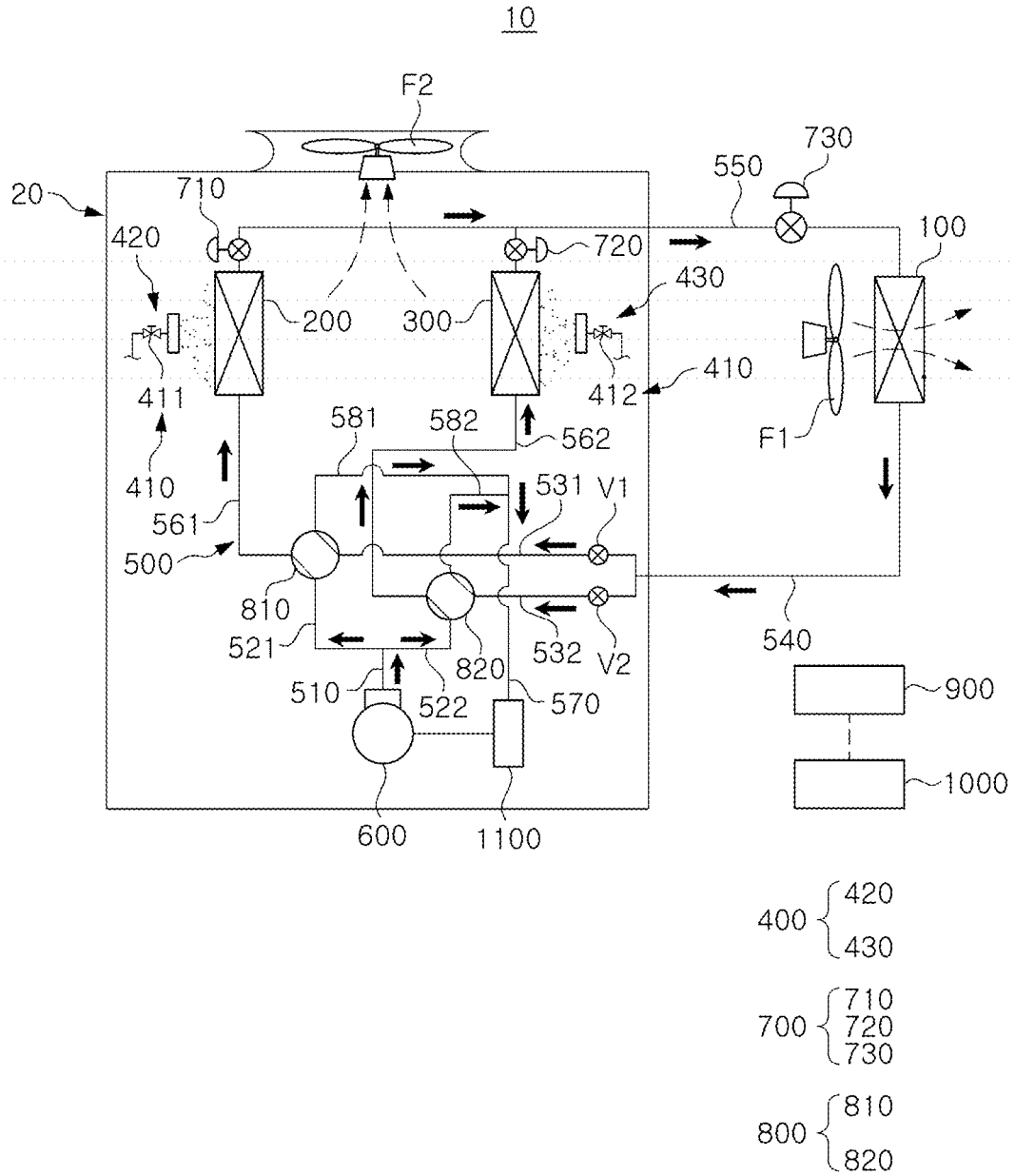
FIG. 2 is a schematic view illustrating an operation process in a cooling mode of a heat pump according to an embodiment of the present invention.
Figure 3:
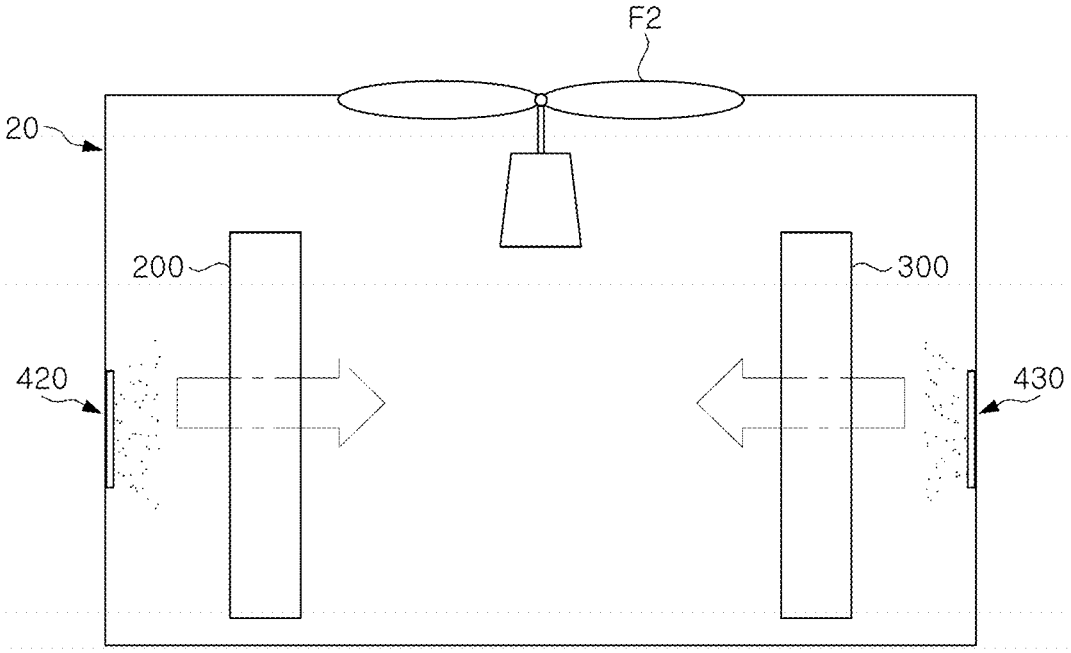
FIG. 3 is a schematic view illustrating an arrangement structure of a water injection module, a second heat exchanger, a third heat exchanger, and an outdoor blower of a heat pump according to an embodiment of the present invention.
Figure 4:
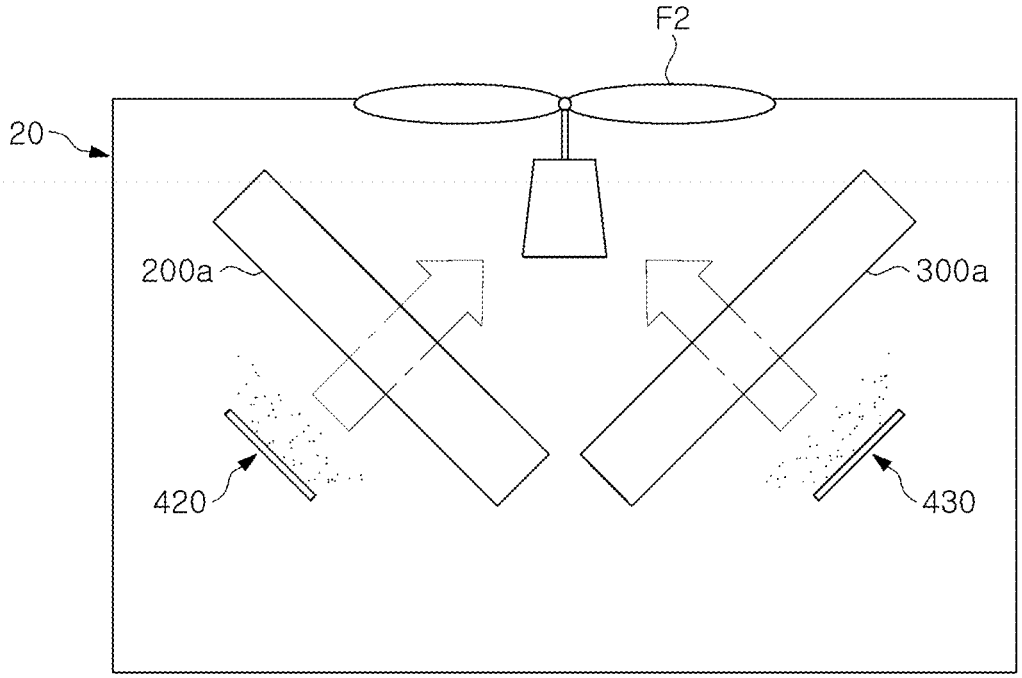
FIG. 4 is a schematic view illustrating a modified embodiment 1 of an arrangement structure of a water injection module, a second heat exchanger, a third heat exchanger, and an outdoor blower of a heat pump according to an embodiment of the present invention.
Figure 5:
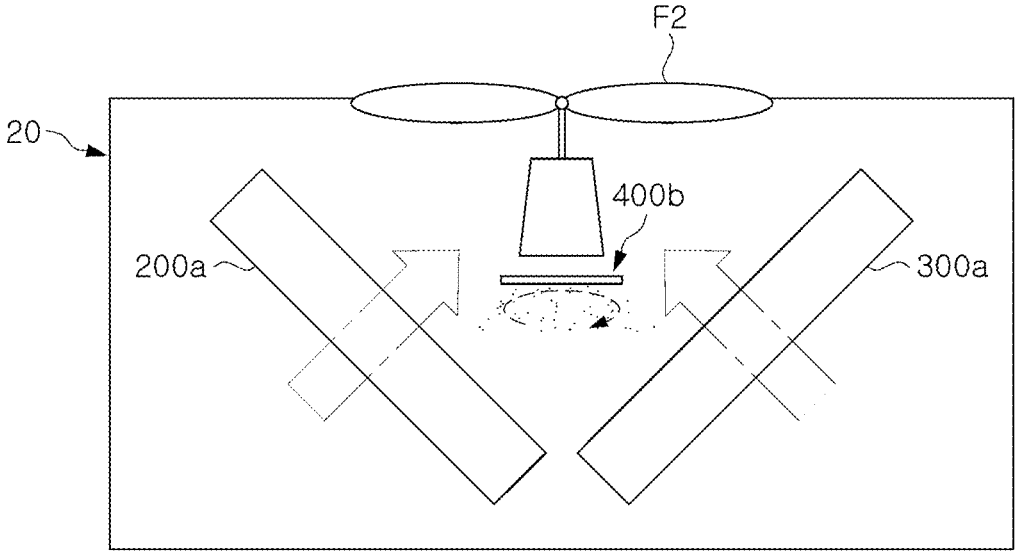
FIG. 5 is a schematic view illustrating a modified embodiment 2 of an arrangement structure of a water injection module, a second heat exchanger, a third heat exchanger, and an outdoor blower of a heat pump according to an embodiment of the present invention.
Figure 6:
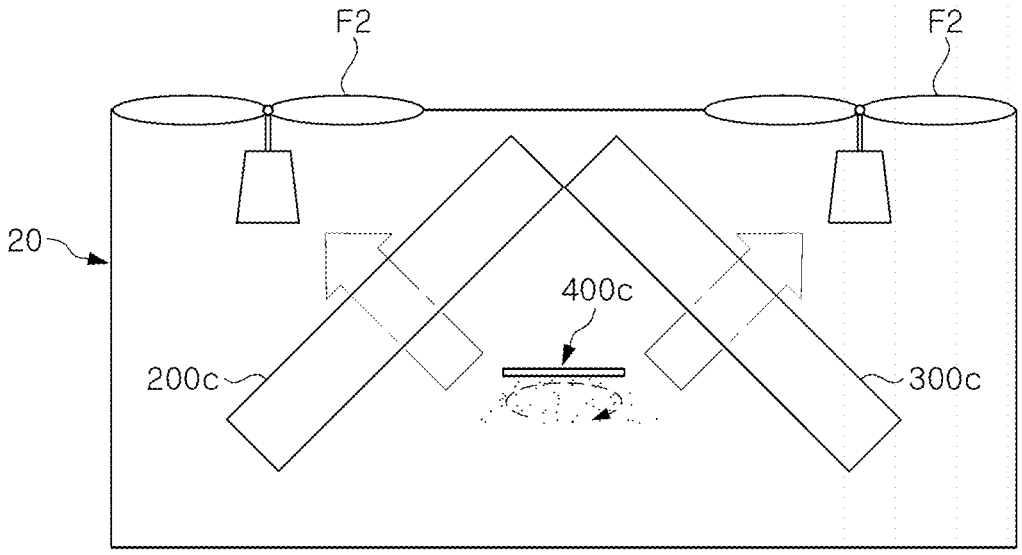
FIG. 6 is a schematic view illustrating a modified embodiment 3 of an arrangement structure of a water injection module, a second heat exchanger, a third heat exchanger, and an outdoor blower of a heat pump according to an embodiment of the present invention.
Figure 7:
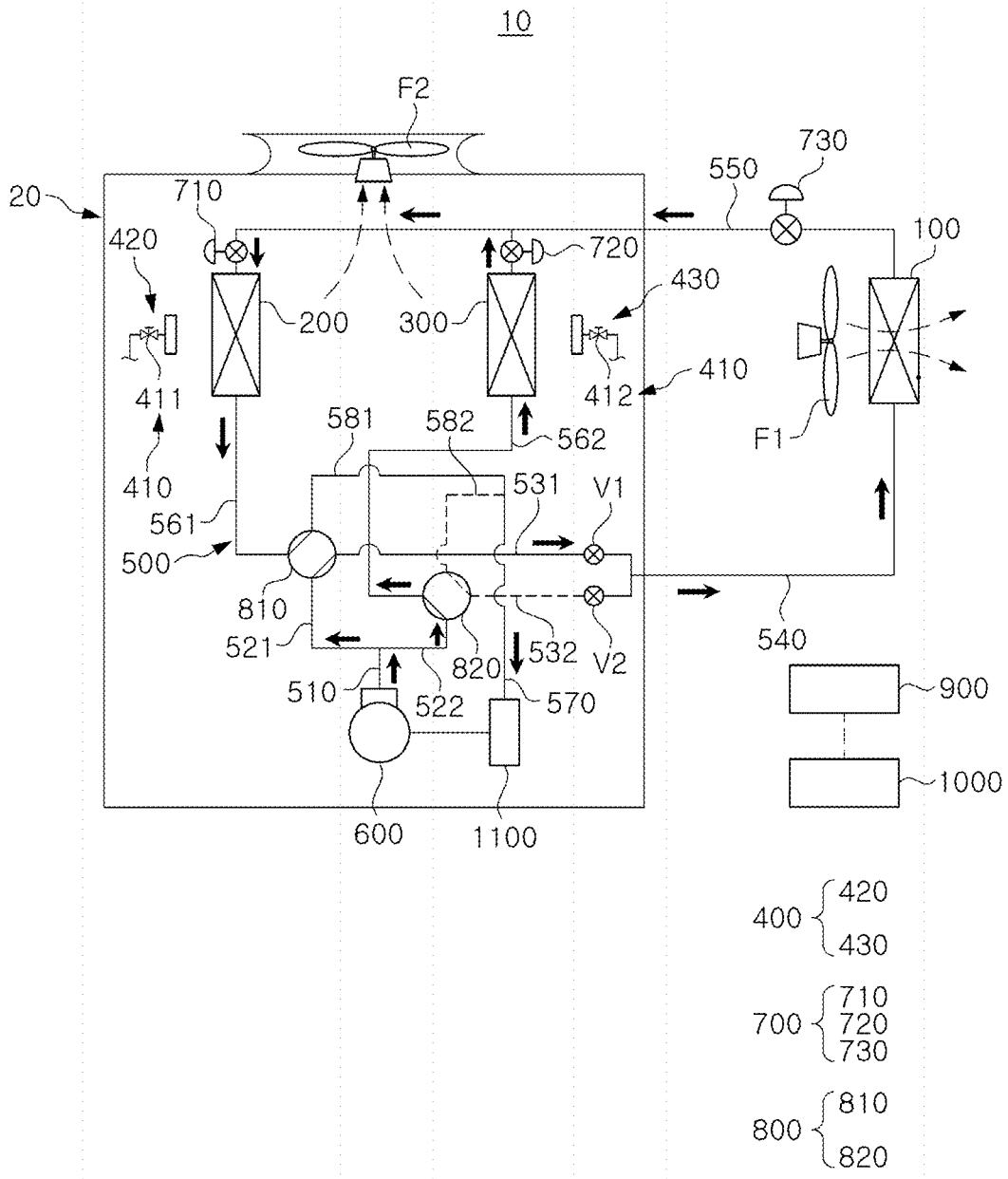
FIG. 7 is a schematic view illustrating an operation process in a defrosting mode of a heat pump according to an embodiment of the present invention.
Figure 8:
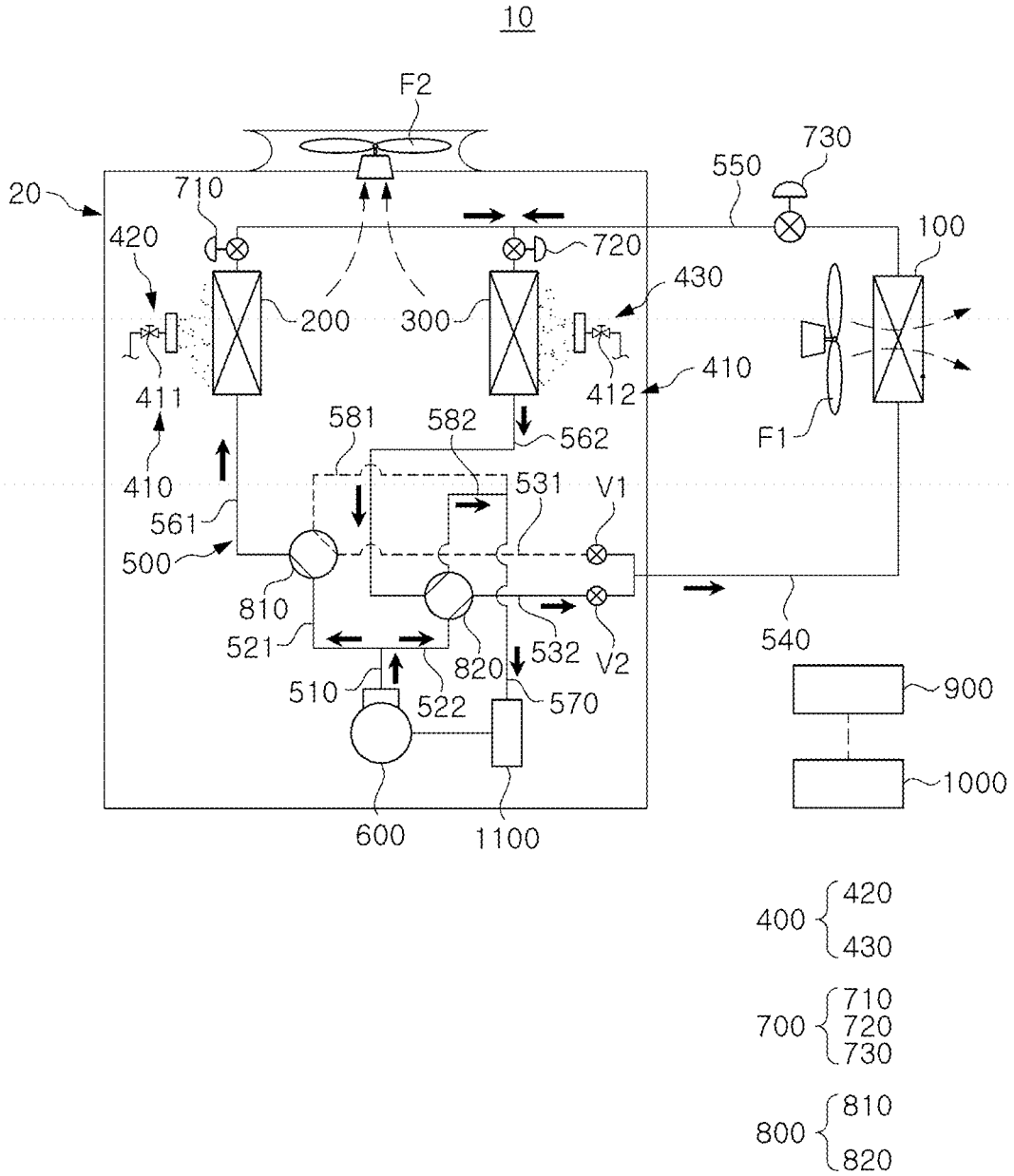
FIG. 8 is a schematic view illustrating an operation process in a cleaning mode of a heat pump according to an embodiment of the present invention.

FIG. 1 is a schematic view illustrating an operation process in the heating mode of a heat pump according to an embodiment of the present invention, FIG. 2 is a schematic view illustrating an operation process in a cooling mode of a heat pump according to an embodiment of the present invention, FIG. 3 is a schematic view illustrating an arrangement structure of a water injection module, a second heat exchanger, a third heat exchanger, and an outdoor blower of a heat pump according to an embodiment of the present invention, FIG. 4 is a schematic view illustrating a modified embodiment 1 of an arrangement structure of a water injection module, a second heat exchanger, a third heat exchanger, and an outdoor blower of a heat pump according to an embodiment of the present invention, FIG. 5 is a schematic view illustrating a modified embodiment 2 of an arrangement structure of a water injection module, a second heat exchanger, a third heat exchanger, and an outdoor blower of a heat pump according to an embodiment of the present invention, and FIG. 6 is a schematic view illustrating a modified embodiment 3 of an arrangement structure of a water injection module, a second heat exchanger, a third heat exchanger, and an outdoor blower of a heat pump according to an embodiment of the present invention. FIG. 7 is a schematic view illustrating an operation process in a defrosting mode of a heat pump according to an embodiment of the present invention, and FIG. 8 is a schematic view illustrating an operation process in a cleaning mode of a heat pump according to an embodiment of the present invention.

Hereinafter, a heat pump according to an embodiment of the present invention will be described with reference to FIGS. 1 to 7.

Referring to FIGS. 1 and 2, a heat pump 10 according to an embodiment of the present invention may include a first heat exchanger 100 disposed indoors, a second heat exchanger 200 and a third heat exchanger 300 disposed outdoors, a fluid tube 500 connected to the first heat exchanger 100, the second heat exchanger 200 and the third heat exchanger 300, a compressor 600 and an expansion valve unit 700 disposed on the fluid tube 500, a flow path switching valve unit 800 configured to switch a path of a fluid discharged from the compressor 600 to flow into at least one of the first heat exchanger 100, the second heat exchanger 200 and the third heat exchanger 300, a processor 900 connected to the flow path switching valve unit 800, and a storage unit 1000 connected to the processor 900.

Additionally, the heat pump 10 according to an embodiment of the present invention may include a water injection module 400 including a flow rate control valve 410 disposed adjacently to the second heat exchanger 200 and the third heat exchanger 300 and configured to control supply of water provided by at least one of the second heat exchanger 200 and the third heat exchanger 300. In this case, the processor 900 may be connected to the flow rate control valve 410 and may control an operation of the flow rate control valve 410.

The flow path switching valve unit 800 may be disposed in the fluid tube 500 and may switch a flow direction of fluid in the fluid tube 500 depending on a heating mode or a cooling mode.

The processor 900 may be connected to the flow rate control valve 410 of the water injection module 400 and the flow path switching valve unit 800 and may execute the program stored in the storage unit 1000.

The storage unit 1000 includes a program of changing the heating mode and the cooling mode. Specifically, the program stored in the storage unit 1000 is a program of changing the heating mode in which the flow path switching valve unit 800 controls the fluid of the compressor 600 to flow into the first heat exchanger 100 by closing the flow rate control valve 410 so that the first heat exchanger 100 operates as a condenser and at least one of the second heat exchanger 200 and the third heat exchanger 300 operates as an evaporator, and a cooling mode in which the flow path switching valve unit 800 controls the fluid of the compressor 600 to flow into at least one of the second heat exchanger 200 and the third heat exchanger 300 by opening the flow rate control valve 410 so that the first heat exchanger 100 operates as an evaporator and at least one of the second heat exchanger 200 and the third heat exchanger 300 operates as a condenser.

Meanwhile, the second heat exchanger 200 and the third heat exchanger 300 are disposed to be connected in series or in parallel to each other by the flow path switching valve unit 800 on the fluid tube 500.

The flow path conversion valve unit 800 may include a plurality of flow path switching valves so that the path of the fluid discharged from the compressor 600 is selectively connected to at least one of the first heat exchanger 100, the second heat exchanger 200 and the third heat exchanger 300. As an example, the flow path switching valve unit 800 may include a first flow path switching valve 810 configured to control the fluid of the compressor 600 to flow into the first heat exchanger 100 or the second heat exchanger 200, and a second flow path switching valve 820 configured to control the fluid of the compressor 600 to flow into the first heat exchanger 100 or the third heat exchanger 300. In other words, depending on the heating mode or the cooling mode of the heat pump 10, the first flow path switching valve 810 and the second flow path switching valve 820 may be controlled to allow the fluid of the compressor 600 to flow into one or two heat exchangers of the first heat exchanger 100, the second heat exchanger 200, and the third heat exchanger 300, thereby performing heating operation or cooling operation. Here, the first flow path switching valve 810 and the second flow path switching valve 820 may be controlled to change a flow manner of the fluid into the first heat exchanger 100, the second heat exchanger 200, and the third heat exchanger 300 on the fluid tube 500.

In the heating mode and the cooling mode, in order to optimize the heating and cooling performance of the second heat exchanger 200 and the third heat exchanger 300 connected in parallel, the second heat exchanger 200 and the third heat exchanger 300 may be connected in series or in parallel to each other by the first flow path switching valve 810 and the second flow path switching valve 820 on the fluid tube 500. In this case, the program stored in the storage unit 1000 may be set to control the first flow path switching valve 810 and the second flow path switching valve 820 so that the second heat exchanger 200 and the third heat exchanger 300 are connected in parallel in the heating mode and the cooling mode, and a detailed explanation thereof will be described below.

As a specific example, as illustrated in FIGS. 1 and 2, the fluid tube 500 may include a first main fluid tube 510 in which one end thereof is connected to an outlet end of the compressor 600, a first branch fluid tube 521 configured to branch off from the other end of the first main fluid tube 510 and connected to the first flow path switching valve 810 and a second branch fluid tube 522 connected to the second flow path switching valve 820, a third branch fluid tube 531 in which one end thereof is connected to the first flow path switching valve 810 and a first opening/closing valve V1 is disposed and a fourth branch fluid tube 532 which one end thereof is connected to the second flow path switching valve 820 and a second opening/closing valve V2 is disposed, the third branch fluid tube 531 and fourth branch fluid tube 532 being arranged in parallel with each other, and a second main fluid tube 540 configured to connect a point in which the other end of the third branch fluid tube 531 and the other end of the fourth branch fluid tube 532 are connected and one end of the first heat exchanger 100, a third main fluid tube 550 in which one end thereof connects the other end of the first heat exchanger 100, a fifth branch fluid tube 561 connected to the first flow path switching valve 810 and on which the first expansion valve 710 and the second heat exchanger 200 are disposed and a sixth branch fluid tube 562 connected to the second flow path switching valve 820 and on which the second expansion valve 720 and the third heat exchanger 300 are disposed, the fifth branch fluid tube 561 and the sixth branch fluid tube 562 branching off from the other end of the third main fluid tube 550, respectively, and a seventh branch fluid tube 581 connected to the first flow path switching valve 810 and connected to the fourth main fluid tube 570 connected to an inlet end of the compressor 600 and an eighth branch fluid tube 582 connected to the second flow path switching valve 820 and connected to the fourth main fluid tube 570. Here, a main expansion valve 730 may be further disposed in the third main fluid tube 550.

In this case, the first flow path switching valve 810 is a four-way valve, and may selectively connect the first branch fluid tube 521 and the fifth branch fluid tube 561 while simultaneously connecting the third branch fluid tube 531 and the seventh branch fluid tube 581, or may connect the first branch fluid tube 521 and the third branch fluid tube 531 while simultaneously connect the fifth branch fluid tube 561 and the seventh branch fluid tube 581.

The second flow path switching valve 820 is a four-way valve, and may selectively connect the second branch fluid tube 522 and the sixth branch fluid tube 562 while simultaneously connecting the fourth branch fluid tube 532 and the eighth branch fluid tube 582, or may connect the second branch fluid tube 522 and the fourth branch fluid tube 532 while simultaneously connecting the sixth branch fluid tube 562 and the eighth branch fluid tube 582.

In this case, each of the first flow path switching valve 810 and the second flow path switching valve 820 may be disposed on a downstream side of the compressor 600, and may switch the flow direction of the fluid so that in the heating mode, the fluid passing through the compressor 600 may flow toward the first heat exchanger 100, and in the cooling mode, the fluid passing through the compressor 600 may flow toward at least one of the second heat exchanger 200 and the third heat exchanger 300.

In the heating mode, the fluid evaporated from at least one of the second heat exchanger 200 and the third heat exchanger 300 operating as an evaporator may be compressed through compressor 600, and as the compressed high-temperature and high-pressure fluid may be condensed in the first heat exchanger 100 operating as a condenser, heat may be dissipated into the inner space, thus performing heating operation.

For example, in the heating mode, the first branch fluid tube 521 and the third branch fluid tube 531 are connected by the first flow path switching valve 810, and the fifth branch fluid tube 561 and the seventh branch fluid tube 581 are connected by the first flow path switching valve 810, and the second branch fluid tube 522 and the fourth branch fluid tube 532 are connected by the second flow path conversion valve 820, and the sixth branch fluid tube 562 and the eighth branch fluid tube 582 are connected by the second flow path conversion valve 820. In this case, the first opening/closing V1 the second valve and opening/closing valve V2 are opened, and the first expansion valve 710, the second expansion valve 720 and the main expansion valve 730 are opened. Accordingly, some of the fluid compressed at high temperature and pressure through the compressor 600 and passing through the first main fluid tube 510 may pass through the first branch fluid tube 521 and the third branch fluid tube 531, and the other of the fluid passing through the first main fluid tube 510 may pass through the second branch fluid tube 522 and the fourth branch fluid tube 532 and may join some of the fluid into the second main fluid tube 540 and may then flow into the first heat exchanger 100 as a condenser and may be condensed in the first heat exchanger 100, thereby performing heating operation. While some of the fluid flowing out of the first heat exchanger 100 and passing through the third main fluid tube 550 pass through the fifth branch fluid tube 561, the fluid decompressed by the first expansion valve 710 may be evaporated in the second heat exchanger 200 operating as an evaporator, and may then flow back into the compressor 600 through the seventh branch fluid tube 581 and the fourth main fluid tube 570, and while the other of the fluid passing through the third main fluid tube 550 passes through the sixth branch fluid tube 562, the fluid whose pressure is reduced by the second expansion valve 720 may be evaporated in the third heat exchanger 300 operating as an evaporator, and may then flow back into the compressor 600 through the eighth branch fluid tube 582 and the fourth main fluid tube 570, thereby circulating the fluid. In the heating mode, if necessary, the first expansion valve 710 and the second expansion valve 720 may be fully opened to switch to a bypass mode, and the flow rate of the fluid may be controlled by the main expansion valve 730. Furthermore, in the heating mode, both the second heat exchanger 200 and the third heat exchanger 300 may be used as evaporators, thereby implementing high-efficiency heating operation.

Additionally, in the cooling mode, the fluid may pass through the compressor 600 to dissipate heat in at least one of the second heat exchanger 200 and the third heat exchanger 300 operating as a condenser, and may pass through the expansion valve unit 700 to absorb indoor heat in the first heat exchanger 100 operating as an evaporator and may be evaporated, thereby performing cool operation the indoor space.

For example, in the cooling mode, the first branch fluid tube 521 and the fifth branch fluid tube 561 are connected by the first flow path switching valve 810, and the third branch fluid tube 531 and the seventh branch fluid tube 581 are connected by the first flow path switching valve 810, and the second branch fluid tube 522 and the sixth branch fluid tube 562 are connected by the second flow path conversion valve 820, and the fourth branch fluid tube 532 and the eighth branch fluid tube 582 are connected by the second flow path conversion valve 820. In this case, the first opening/closing valve V1 and the second opening/closing valve V2 are opened, and the first expansion valve 710, the second expansion valve 720 and the main expansion valve 730 are opened. Accordingly, some of the fluid compressed at high temperature and pressure through the compressor 600 and passing through the first main fluid tube 510 may be condensed by the second heat exchanger 200 operating as a condenser through the first branch fluid tube 521 and the fifth branch fluid tube 561 and may be decompressed by the first expansion valve 710, and the other of the fluid may be condensed by the third heat exchanger 300 through the second branch fluid tube 522 and the sixth branch fluid tube 562 and may be decompressed by the second expansion valve 720, and may join some of the fluid into the third main fluid tube 550, and may then flow into the first heat exchanger 100 operating as an evaporator and be evaporated in the first heat exchanger 100, thereby performing cooling operation. The fluid flowing out of the first heat exchanger 100 and passing through the second main fluid tube 540 may pass through the seventh branch fluid tube 581 and the eighth branch fluid tube 582, respectively, and may then join the fourth main fluid tube 570, and may flow back into the compressor 600, thereby circulating the fluid. Here, in the cooling mode, through the water injection to the second heat exchanger 200 and the third heat exchanger 300 by a water injection module 400 to be described below, the fluid may be condensed more efficiently to effectively improve cooling efficiency. In the cooling mode, if necessary, the first expansion valve 710 and the second expansion valve 720 may be fully opened to switch to the bypass mode, and the flow rate of the fluid may be controlled by the main expansion valve 730. Furthermore, in the heating mode, both the second heat exchanger 200 and the third heat exchanger 300 may be used as condensers, thereby implementing high-efficiency cooling operation. In the cooling mode, the flow rate of the fluid flowing through the second heat exchanger 200 and the third heat exchanger 300 may be controlled equally, and also, in order to allow more fluid to flow into one of the second heat exchanger 200 and the third heat exchanger 300 as needed, the cooling performance may be optimized by controlling an opening degree of the first expansion valve 710 or the second expansion valve 720.

Additionally, the heat pump 10 may further include a gas-liquid separator 1100 disposed on an upstream side of the compressor 600 in a flow direction of a fluid in both the cooling mode and the heating mode, and serves to filter liquid fluid from the fluid introduced into the compressor 600 by the gas-liquid separator 1100. In other words, the gas-liquid separator 1100 may be disposed in the fourth main fluid tube 570 of the fluid tube 500 connected between the first flow path switching valve 810 and the second flow path switching valve 820 and the compressor 600, and thus, the gas-liquid separator 1100 may be disposed on the upstream side of the compressor 600 in both the cooling mode and the heating mode by switching the flow direction of the fluid by the first flow path switching valve 810 and the second flow path switching valve 820, so that since the fluid passing through the gas-liquid separator 1100 may be allowed to flow into the compressor 600, thereby realizing a filtering effect on the fluid.

The first heat exchanger 100 may be a general air-cooling type heat exchanger.

The second heat exchanger 200 and the third heat exchanger 300 may operate as an evaporative condenser in the cooling mode by the water injection module 400 disposed adjacently to the second heat exchanger 200 and the third heat exchanger 300. The water injection module 400 may be disposed on one side of the second heat exchanger 200 and the third heat exchanger 300 and may include a spray portion supplying water toward the second heat exchanger 200 and the third heat exchanger 300, and a flow control valve 410 configured to control the supply of water provided to the second heat exchanger 200 and the third heat exchanger 300.

Here, the water injection module 400 may be implemented in various forms as needed, and may be implemented in a structure supplying water to the second heat exchanger 200 and the third heat exchanger 300 by including a single water injection device, or may be implemented in a structure supplying water to each of the second heat exchanger 200 and the third heat exchanger 300 by including two water injection devices.

For example, as illustrated in FIG. 3, the water injection module 400, the second heat exchanger 200, and the third heat exchanger 300 may be disposed inside an outdoor unit 20. The water injection module 400 may include a first water injection device 420 and a second water injection device 430. In this case, the flow control valve 410 may be comprised of a first flow control valve 411 and a second flow control valve 412 provided in each of the first water injection device 420 and the second water injection device 430. The first water injection device 420 may be disposed adjacently to the second heat exchanger 200 and may include the first flow control valve 411 configured to control the supply of water provided to the second heat exchanger 200. The second water injection device 430 may be disposed adjacently to the third heat exchanger 300 and may include a second flow control valve 412 configured to control the supply of water provided to the third heat exchanger 300.

In this case, when the second heat exchanger 200 and the third heat exchanger 300 operate as condensers in the cooling mode, the second heat exchanger 200 and the third heat exchanger 300 perform water injection into the second heat exchanger 200 and the third heat exchanger 300 and operate as evaporation condensers by opening the first flow rate control valve 411 of the first water injection device 420 and the second flow rate control valve 412 of the second water injection device 430. A recovery device (not illustrated) containing water supplied through the first water injection device 420 and the second water injection device 430 may be further disposed below the second heat exchanger 200 and the third heat exchanger 300. Meanwhile, when the second heat exchanger 200 and the third heat exchanger 300 operate as evaporators in the heating mode, the second heat exchanger 200 and the third heat exchanger 300 perform an evaporation operation in an air-cooling manner by the second heat exchanger 200 and the third heat exchanger 300 without water injection of the first water injection device 420 and the second water injection device 430. That is, when the second heat exchanger 200 and the third heat exchanger 300 operate as evaporators in the heating mode, the second heat exchanger 200 and the third heat exchanger 300 operate as air-cooling type evaporators without water injection into the second heat exchanger 200 or the third heat exchanger 300 by closing the first flow control valve 411 and the second flow control valve 412. The second heat exchanger 200 and the third heat exchanger 300 may have a structure including fins with excellent water spreading properties in the cooling mode.

The second heat exchanger 200 and the third heat exchanger 300 may be formed of heat exchangers with the same structure or different structures. Additionally, the second heat exchanger 200 and the third heat exchanger 300 may be evaporative heat exchangers having various forms as a structure assisting to cool the fluid by evaporating water by injecting water on surfaces of the second heat exchanger 200 and the third heat exchanger 300, and for example, an evaporative condenser disclosed in published patents such as KR10-2019-0006781, KR10-2022-0074734, and KR10-2021-0070921 may be used, but the present invention is not limited thereto. By utilizing the second heat exchanger 200 and the third heat exchanger 300, in the cooling mode, the fluid may be condensed more efficiently using the heat of evaporation through water injection in the second heat exchanger 200 and the third heat exchanger 300, so that the cooling efficiency of the heat pump 10 may be effectively improved.

The heat pump 10 may further include an indoor blower F1 forming an air flow passing through the first heat exchanger 100 and an outdoor blower F2 forming an air flow passing through the second heat exchanger 200 and the third heat exchanger 300. The indoor blower F1 and the outdoor blower F2 may be in the form of a blowing fan. The outdoor blower F2 may be provided in one form or plural form depending on actual needs. For example, as illustrated in FIGS. 1 to 3, the outdoor blower F2 may be formed of one fan and may be disposed between the second heat exchanger 200 and the third heat exchanger 300. Accordingly, the second heat exchanger 200 and the third heat exchanger 300 may share one outdoor blower F2, which may compact the structure of the heat pump 10 and reduce manufacturing costs.

In FIG. 3, the second heat exchanger 200 and the third heat exchanger 300 are illustrated as being arranged in a vertical direction; however, the present invention is not limited thereto and may be disclosure in various forms.

As another example, as illustrated in FIG. 4, a second heat exchanger 200*a* and a third heat exchanger 300*a* may be disposed on the fluid tube 500 to be inclined at a certain angle from the vertical direction. The second heat exchanger 200*a* and the third heat exchanger 300*a* may be disposed on the fluid tube 500 to be inclined at a certain angle in directions opposite to each other from the vertical direction. In this case, the first watering device 420 and the second watering device 430 may be disposed on an external side of the second heat exchanger 200*a* and the third heat exchanger 300*a* which is an opposite side from the one side facing the outdoor blower F2. Accordingly, the water injection by the first watering device 420 and the second watering device 430 may be performed over a sufficient contact area of the second heat exchanger 200*a* and the third heat exchanger 300*a*, thereby significantly heat exchange efficiency. Furthermore, according to this arrangement structure, heat exchange between the second heat exchanger 200*a* and the third heat exchanger 300*a* and the outdoor air may be performed more smoothly by one outdoor blower F2, thereby further improving the cooling performance.

As another example, as illustrated in FIG. 5, the second heat exchanger 200*a* and the third heat exchanger 300*a* may be disposed on the fluid tube 500 to be inclined at a certain angle in directions opposite to each other from the vertical direction, similarly to that illustrated in FIG. 4. In this case, as illustrated in FIG. 5, a water injection module 400*b* to which one water injection device 440 is applied may be disposed adjacently to the second heat exchanger 200*a* and the third heat exchanger 300*a*. Accordingly, the second heat exchanger 200*a* and the third heat exchanger 300*a* may share one water injection device 440, thereby reducing a water injection amount and energy.

Additionally, as another example, as illustrated in FIG. 6, a second heat exchanger 200*c* and a third heat exchanger 300*c* may be disposed on the fluid tube 500 to be inclined at a certain angle in directions opposite to each other from the vertical direction. In this case, a water injection module 400*c* to which one water injection device 450 is applied may be disposed adjacently to the second heat exchanger 200*c* and the third heat exchanger 300*c*. The outdoor blower F2 may be implemented as two outdoor blowers disposed adjacently to each of the second heat exchanger 200*c* and the third heat exchanger 300*c*.

In addition to the arrangement structure of the water injection module, the second heat exchanger, the third heat exchanger, and the outdoor blower illustrated in FIGS. 3 to 6, various arrangement forms may be implemented, which may also fall within the scope of the present invention.

In order to easily described the present invention, the heat pump 10 to which the arrangement structures of the water injection module 400, the second heat exchanger 200, the third heat exchanger 300 and the outdoor blower F2 illustrated in FIG. 3 are applied will be described.

The processor 900 may be connected to the first flow rate control valve 411 of the first water injection device 420, the second flow rate control valve 412 of the second water injection device 430, the first flow path switching valve 810, and the second water flow control valve 820, and may execute a program stored in the storage unit 1000.

Specifically, as illustrated in FIG. 1, the processor 900 may execute the program, and may close the first flow control valve 411 of the first water injection device 420 and the second flow rate control valve 412 of the second water injection device 430 so that in the heating mode, the first heat exchanger 100 operates as a condenser and the second heat exchanger 200 and the third heat exchanger 300 operate as evaporators, and the first flow path switching valve 810 and the second flow path switching valve 820 may control the fluid of the compressor 600 to flow into the first heat exchanger 100. Accordingly, in the heating mode, the heat pump 10 may absorb heat from the outdoor air while maintaining a constant temperature differential lower than a set temperature range as compared to the outdoor air temperature in each of the second heat exchanger 200 and the third heat exchanger 300 in the heating mode, so that both the second heat exchanger 200 and the third heat exchanger 300 may operate as evaporators to optimize evaporation performance.

Additionally, as illustrated in FIG. 2, the processor 900 may execute the program, and may open the first flow rate control valve 411 of the first water injection device 420 and the second flow rate control valve 412 of the second water injection device 430 so that in the cooling mode, the first heat exchanger 100 operates as an evaporator and the second heat exchanger 200 and the third heat exchanger 300 operate as condensers, and the first flow path switching valve 810 and the second flow path switching valve 820 may control the fluid of the compressor 600 to flow into the second heat exchanger 200 and the third heat exchanger 300. Accordingly, the heat pump 10 may allow the fluid to flow into the second heat exchanger 200 and the third heat exchanger 300 in the cooling mode, and may condense the fluid more efficiently through water injection into the second heat exchanger 200 and the third heat exchanger 300 by the water injection module 400, thereby effectively the cooling efficiency.

Additionally, when one of the second heat exchanger 200 and the third heat exchanger 300 needs to be defrosted in the heating mode, the program may be set to control the first flow path switching valve 810 and the second flow path switching valve 820 so that the second heat exchanger 200 and the third heat exchanger 300 are connected in series. That is, the program may be set to change the heating mode to a defrosting mode when frost formation occurs in one of the second heat exchanger 200 and the third heat exchanger 300. In the defrosting mode, one of the second heat exchanger 200 and the third heat exchanger 300, which is subject to a defrosting target, operates as a condenser, and the one of the second heat exchanger 200 and the third heat exchanger 300 as a defrosting target may control the flow control valve 410 to selectively supply water, and the program is set to change the heating mode to the defrosting mode of controlling the fluid of the compressor 600 to flow into one of the first heat exchanger 100 and the second heat exchanger 200, and the third heat exchanger 300, which is subject the defrosting target, respectively, so that the first flow path switching valve 810 and the second flow path switching valve 820 are connected to the second heat exchanger 200 and the third heat exchanger 300 in series, and controlling the fluid to simultaneously join another exchange operating as an evaporator.

As an example, as illustrated in FIG. 7, when the third heat exchanger 300 is subject to a defrosting target in the heating mode, the first branch fluid tube 521 and the third branch fluid tube 531 are connected and the fifth branch fluid tube 561, and the seventh branch fluid tube 581 are connected in the same manner as the connection manner in heating mode by the first flow path conversion valve 810. The second branch fluid tube 522 and the sixth branch fluid tube 562 are connected, and the fourth branch fluid tube 532 and the eighth branch fluid tube 582 are connected, in the same manner as the connection manner in cooling mode by the second flow path switching valve 820. In this case, the first opening/closing valve V1 is opened and the second opening/closing valve V2 is closed to block a connection flow path between the fourth branch fluid tube 532 and the eighth branch fluid tube 582. Accordingly, some of the fluid compressed at high temperature and pressure through the compressor 600 and passing through the first main fluid tube 510 may be condensed by the first heat exchanger 100 operating as a condenser through the first branch fluid tube 521, the third branch fluid tube 531 and the second main fluid tube 540 and may be decompressed by the main expansion valve 730, and the other of the fluid passing through the first main fluid tube 510 may be condensed by the third heat exchanger 300 through the second branch fluid tube 522 and the sixth branch fluid tube 562 and may be decompressed by the second expansion valve 720, and may join some of the fluid into the fifth branch fluid tube 561, and may then flow into the second heat exchanger 200 operating as an evaporator and may be evaporated in the second heat exchanger 200, and may flow back into the compressor 600 through the seventh branch tube 581 and the fourth main fluid tube 570, thereby circulating fluid. Here, even in the process of performing a defrosting operation on the third heat exchanger 300, normal operation of the continuous heating mode may be secured by operations of the first heat exchanger 100 operating as a condenser, and the second heat exchanger 200 operating as an evaporator, and various heating modes may be performed as needed, thus securing heating performance. Furthermore, in the defrosting mode, when an outdoor air temperature meets a certain temperature range above zero, a quick defrosting operation may be performed by opening the second flow control valve 412 of the second water injection device 430 to performing water injection into the third heat exchanger 300. Specifically, as needed, the water injection may be controlled to proceed only in an initial stage of the defrosting mode or to proceed in an overall defrosting mode.

Here, the defrosting operation for the third heat exchanger 300 has been described, but in the defrosting operation for the second heat exchanger 200, similarly, the second heat exchanger 200 and the third heat exchanger 300 may be connected in series so that both the first heat exchanger 100 and the second heat exchanger 200 operate as condensers, and the third heat exchanger 300 operates as an evaporator, and thus, the fluid from the compressor may pass through the first heat exchanger 100 and the second heat exchanger 200, respectively, and may then flow into the third heat exchanger 300, even in a process of performing the defrosting operation on the second heat exchanger 200, the normal operation of the continuous heating mode may be secured by the operations of the first heat exchanger 100 operating as a condenser and the third heat exchanger 300 operating as an evaporator, and detailed description thereof will be omitted. Furthermore, while periodically performing the defrosting mode for the second heat exchanger 200 and the third heat exchanger 300 in the heating mode, it may also be possible to secure the normal operation in the continuous heating mode.

In the above description, both the second heat exchanger and the third heat exchanger were described as operating as evaporators or condensers in the heating mode or the cooling mode, but the present disclosure is not limited thereto, and if necessary, only one of the second one third heat exchanger may selectively operate. In this case, components such as an opening and closing valve configured to open and close a flow path may be implemented to be further included in the fluid tube, and as an example, opening/closing valves may be implemented to be further included in the fifth branch fluid tube and the sixth branch fluid tube of the fluid tube to selectively operate one of the second heat exchanger and the third heat exchanger.

Meanwhile, referring to FIGS. 1 to 8, a control method of a heat pump according to an embodiment of the present invention is provided. Here, the heat pump 10 described above may be applied as the heat pump. Specifically, the heat pump 10 may include a first heat exchanger 100 disposed indoors; a second heat exchanger 200 and a third heat exchanger 300 disposed outdoors; a water injection module 400 disposed adjacently to the second heat exchanger 200 and the third heat exchanger 300 and supplying water to at least one of the second heat exchanger 200 and the third heat exchanger 300; and a flow path switching valve unit 800 in which, on the fluid tube 500 connected to the first heat exchanger 100, the second heat exchanger 200 and the third heat exchanger 300, the second heat exchanger 200 and the third heat exchanger 300 are connected in series or in parallel to change a path of the fluid discharged from the compressor 600 so that the fluid flows into at least one of the first heat exchanger 100, the second heat exchanger 200, and the third heat exchanger 300. Here, the flow path switching valve unit 800 includes the first flow path switching valve 810 and the second flow path switching valve 820 described above, and the water injection module 400 has a structure including the first water injection device 420 including the first flow rate control valve 411 and the second water injection device 430 including the second flow rate control valve 412 described above. In the control method of the heat pump 10 having such a configuration, in the heating mode, the first heat exchanger 100 is controlled to operate as a condenser, and the second heat exchanger 200 and the third heat exchanger 300 are controlled to operate as evaporators, and in the cooling mode, the first heat exchanger 100 is controlled to operate as an evaporator, and the second heat exchanger 200 and the third heat exchanger 300 are controlled to operate as condensers while performing the water injection by the water injection module 400.

Additionally, in the control method of the heat pump 10 according to an embodiment of the present invention, when frost formation occurs in one of the second heat exchanger 200 and the third heat exchanger 300 in the heating mode, the first heat exchanger 100 may be controlled to operate as a condenser, and one of the second heat exchanger 200 and the third heat exchanger 300 connected in series by the flow path switching valve unit 800, which is subject to the defrosting target, may be controlled to operate as a condenser, and the other thereof may be controlled to perform a defrosting mode of operating as an evaporator.

Here, the control method of the heat pump 10 is identical to the control methods of the heating mode, the cooling mode and the defrosting mode of the heat pump 10 described above, and description thereof will be omitted to avoid duplication.

Depending on an operating state of the water injection module 400 in the cooling mode, a blowing amount of the outdoor blower F2 forming a flow of air passing through the second heat exchanger 200 and the third heat exchanger 300 may be controlled. For example, by controlling the water supply amount of the water injection module 400 and the blowing amount of the outdoor blower F2 in the cooling mode, cooling operation may be performed optimally in terms of energy conservation and cost reduction. Additionally, when water supply to the water injection module 400 is not smooth or a malfunction occurs, the second heat exchanger 200 and the third heat exchanger 300 may operate as air-cooling type heat exchangers to increase the blowing volume of the outdoor blower F2 forming the flow of air passing through the second heat exchanger 200 and the third heat exchanger 300.

The control method of the heat pump 10 according to an embodiment of the present invention may control a cleaning mode to be performed after the cooling mode. In the cleaning mode, the first heat exchanger 100 may be controlled to operate as a condenser for a certain period of time. Accordingly, the cleaning mode may be performed after the cooling mode to dry the first heat exchanger 100, thereby preventing an occurrence of mold the like, due to moisture. Here, the operation of the indoor blower F1 may be stopped as needed.

Furthermore, in the cleaning mode, operations of the indoor blower F1 and the outdoor blower F2 may be stopped and the first heat exchanger 100 may operate as a condenser for a certain period of time, and one of the second heat exchanger 200 and the third heat exchanger 300 connected in series by the flow path switching valve unit 800, which is subject to a cleaning target, may be controlled operate as an evaporator to perform the water injection by the water injection module 400, and the other of the second heat exchanger 200 and the third heat exchanger 300 may be controlled to operate as a condenser. In other words, in the cleaning mode, one of the second heat exchanger 200 and the third heat exchanger 300, which is subject to the clearing target, may operate as an evaporator for a certain period of time and the flow control valve 410 may be controlled to supply water to one heat exchanger as the cleaning target, and the first flow path switching valve 810 and the second flow path switching valve 820 may be controlled so that the second heat exchanger 200 and the third heat exchanger 300 may be connected in series and the fluid of the compressor 600 may flow into the other of the first heat exchanger 100, the second heat exchanger 200 and the third heat exchanger 300 operating as the condenser, and may join one heat exchanger as the cleaning target.

For example, in the cleaning mode, the indoor blower F1 and the outdoor blower F2 first stop operating. As illustrated in FIG. 8, when the third heat exchanger 300 is subject to a clearing target, the first branch fluid tube 521 and the fifth branch fluid tube 561 are connected and the third branch fluid tube 531 and the seventh branch fluid tube 581 are connected in the same manner as the connection manner in the cooling mode by the first flow path switching valve 810. The second branch fluid tube 522 and the fourth branch fluid tube 532 are connected and the sixth branch fluid tube 562 and the eighth branch fluid tube 582 are connected in the same manner as the connection manner in the heating mode by the second flow path switching valve 820. In this case, the first opening/closing valve V1 is closed to block the connecting flow path between the third branch fluid tube 531 and the seventh branch fluid tube 581, and the second opening/closing valve V2 is opened. Accordingly, some of the fluid compressed at high temperature and pressure through the compressor 600 and passing through the first main fluid tube 510 may be condensed by the second heat exchanger 200 operating as the condenser through the first branch fluid tube 521 and the fifth branch fluid tube 561 and may be decompressed by the first expansion valve 710, and the other of the fluid passing through the first main fluid tube 510 may be condensed by the first heat exchanger 100 operating as the condenser through the second branch fluid tube 522, the fourth branch fluid tube 532 and the second main fluid tube 540 and may be decompressed by the main expansion valve 730 while passing through the third main fluid tube 550, and may join some of the fluid into the sixth branch fluid tube 562 and may then flow to the third heat exchanger 300 operating as the evaporator, thereby including forced frost formation to occur in the third heat exchanger 300, and the second flow control valve 412 of the second water injection device 430 may be opened to perform the water injection into the third heat exchanger 300, so that foreign substances such as dust and the like, attached to the third heat exchanger 300, may be cleaned along with ice implanted in the third heat exchanger 300. After the fluid is evaporated in the third heat exchanger 300, the fluid may be circulated by flowing back into the compressor 600 through the eighth branch tube 582 and the fourth main fluid tube 570. Accordingly, in the cleaning mode, the first heat exchanger 100 and the second heat exchanger 200 or the third heat exchanger 300 may be cleaned at the same time, thus improving cleaning efficiency. Here, the present invention is not limited to the control method of the cleaning modes, but cleaning may be performed in various cleaning modes, and for example, the cleaning may be performed by performing the water injection into the second heat exchanger 200 and the third heat exchanger 300 at the same time in the cooling mode.

Here, the cleaning operation for the third heat exchanger 300 has been described, but similarly to the cleaning operation for the second heat exchanger 200, the second heat exchanger 200 and the third heat exchanger 300 may be connected in series, so that both the first heat exchanger 100 and the third heat exchanger 300 operate as condensers, and the second heat exchanger 200 operates as an evaporator, and thus, the fluid from the compressor 600 may pass through the first heat exchanger 100 and the third heat exchanger 300, respectively, and may then flow into the second heat exchanger 200 to allow the water injection to be performed into the second heat exchanger 200, thereby cleaning foreign substances such as dust and the like, attached to ice forcefully subjected to the frost formation.

Accordingly, according to the heat pump 10 and the control method thereof according to the embodiment of the present invention described above, the cooling performance and the heating performance of the heat pump 10 may be improved by using the first heat exchanger 100, the second heat exchanger 200, and the third heat exchanger 300. Additionally, in the cooling mode, the fluid may be condensed more efficiently through the water injection into at least one of the second heat exchanger 200 and the third heat exchanger 300, thereby effectively performing the cooling efficiency. Furthermore, in the process of performing the defrost operation on the second heat exchanger 200 or the third heat exchanger 300, the normal operation the in continuous heating mode may be secured.

Here, the manner in which both the second heat exchanger 200 and the third heat exchanger 300 operate as evaporators or condensers in the heating mode or the cooling mode for the heat pump 10 and the control method thereof according to the embodiment of the present invention were specifically described, but the present invention is not limited thereto, and if necessary, heating operation or cooling operation may be performed by selecting one of the second heat exchanger 200 and the third heat exchanger 300, and this may also fall within the scope of the present invention.

In the present invention, both the second heat exchanger and the third heat exchanger were described as an example including an evaporative condenser configured to perform the water injection by the water injection module, but the present invention is not limited thereto, and one of the second heat exchanger and the third heat exchanger may be configured as an evaporative heat exchanger performing the water injection by the water injection module, and the other thereof may be configured as a general air-cooling type heat exchanger.

Additionally, the above-described embodiments may be combined with each other as long as the technical contents do not contradict each other without departing from the technical spirit of the present invention, which may also fall within the scope of the present invention.

What is claimed is:

1. A heat pump, comprising: a first heat exchanger disposed indoors, a second heat exchanger and a third heat exchanger disposed outdoors, a fluid tube connected to the first heat exchanger, the second heat exchanger and the third heat exchanger, a compressor and an expansion valve unit disposed on the fluid tube, a flow path switching valve unit configured to switch a path of a fluid discharged from the compressor to flow into at least one of the first heat exchanger, the second heat exchanger and the third heat exchanger, a processor connected to the flow path switching valve unit, and a storage unit connected to the processor, wherein the second heat exchanger and the third heat exchanger are disposed to be connected in series or in parallel to each other by the flow path switching valve unit on the fluid tube, the flow path switching valve unit includes a first flow path switching valve configured to control the fluid of the compressor to flow into the first heat exchanger or the second heat exchanger, and a second flow path switching valve configured to control the fluid of the compressor to flow into the first heat exchanger or the third heat exchanger, and the storage unit includes a program for the flow path switching valve unit to perform:

a heating mode in which the flow path switching valve unit controls a fluid from the compressor to flow into the first heat exchanger so that the first heat exchanger operates as a condenser and at least one of the second heat exchanger and the third heat exchanger operates as an evaporator, a cooling mode in which the flow path switching valve unit controls the fluid of the compressor to flow into at least one of the second heat exchanger and the third heat exchanger so that the first heat exchanger operates as an evaporator and at least one of the second heat exchanger and the third heat exchanger operates as a condenser, and a cleaning mode switched from the cooling mode for a certain period of time, in which the first heat exchanger operates as a condenser.

2. The heat pump according to claim 1, comprising:

a water injection module including a flow rate control valve disposed adjacently to the second heat exchanger and the third heat exchanger to control supply of water provided to at least one of the second heat exchanger and the third heat exchanger, wherein the processor is connected to the flow rate control valve, and the program is set to close the flow rate control valve in the heating mode and open the flow rate control valve in the cooling mode.

3. The heat pump according to claim 1, wherein the program is set to connect the second heat exchanger and the third heat exchanger in parallel by control of the first flow path switching valve and the second flow path switching valve in the heating mode and the cooling mode.

4. The heat pump according to claim 3, wherein when one of the second heat exchanger and the third heat exchanger needs to be defrosted in the heating mode, the program is set to connect the second heat exchanger and the third heat exchanger in series by the control of the first flow path switching valve and the second flow path switching valve.

5. The heat pump according to claim 2, wherein the water injection module includes a first water injection device including a first flow rate control valve disposed adjacently to the second heat exchanger and configured to control supply of water provided to the second heat exchanger, and a second water injection device including a second flow rate control valve disposed adjacently to the third heat exchanger and configured to control supply of water provided to the third heat exchanger.

6. The heat pump according to claim 2, wherein the second heat exchanger and the third heat exchanger are disposed on the fluid tube to be inclined at a predetermined angle in a vertical direction.

7. A control method of a heat pump including: a first heat exchanger disposed indoors; a second heat exchanger and a third heat exchanger disposed outdoors; a water injection module disposed adjacently to the second heat exchanger and the third heat exchanger and configured to supply water to at least one of the second heat exchanger and the third heat exchanger; and a flow path switching valve unit configured to change a path of a fluid discharged from a compressor by connecting the second heat exchanger and the third heat exchanger in series or in parallel, to flow into at least one of the first heat exchanger, the second heat exchanger and the third heat exchanger, on a fluid tube connected to the first heat exchanger, the second heat exchanger and the third heat exchanger, wherein in a heating mode, the first heat exchanger operates as a condenser and the second heat exchanger and the third heat exchanger operate as evaporators, and in a cooling mode, the first heat exchanger operates as an evaporator, and the second heat exchanger and the third heat exchanger operate as condensers, so that water injection is controlled by the water injection module, and in a cleaning mode, the first heat exchanger operates as a condenser and at least one of the second heat exchanger and third heat exchanger operates as a evaporator for a certain period of time is controlled to be performed after the cooling mode.

8. The control method of a heat pump according to claim 7, wherein in the cooling mode, a blowing amount of an outdoor blower forming a flow of air passing through the second heat exchanger and the third heat exchanger is controlled depending on an operating status of the water injection module.

9. The control method of a heat pump according to claim 7, wherein in the cleaning mode, an operation of an indoor blower forming a flow of air passing through the first heat exchanger and an outdoor blower forming a flow of air passing through the second heat exchanger and the third heat exchanger is stopped, and for a certain period of time, the first heat exchanger operates as a condenser, and one of the second heat exchanger and the third heat exchanger connected in series by the flow path switching valve unit, which is subject to a cleaning target, is controlled to operate as an evaporator to perform water injection by the water injection module, and the other of the second heat exchanger and the third heat exchanger is controlled to operate as a condenser.

10. The control method of a heat pump according to claim 7, wherein in the heating mode, when frost formation occurs in one of the second heat exchanger and the third heat exchanger, the first heat exchanger is controlled to operate as a condenser, and one of the second heat exchanger and the third heat exchanger connected in series by the flow path switching valve unit, which is subject to a defrosting target, is controlled to operate as a condenser and the other thereof is controlled to perform a defrosting mode of operating as an evaporator.

* * * * *